US006210101B1

(12) United States Patent
Horng

(10) Patent No.: US 6,210,101 B1
(45) Date of Patent: Apr. 3, 2001

(54) COMBINED STRUCTURE OF CROSS-FLOW FAN

(75) Inventor: Alex Horng, Kaohsung (TW)

(73) Assignee: Sunonwealth Electric Machine Industry Co., Ltd. (CN)

( * ) Notice: Subject to any disclaimer, the term of this patent is extended or adjusted under 35 U.S.C. 154(b) by 0 days.

(21) Appl. No.: 09/271,097

(22) Filed: Mar. 17, 1999

(30) Foreign Application Priority Data

Aug. 27, 1998 (TW) ..... 87212124

(51) Int. Cl.[7] ..... F04D 5/00

(52) U.S. Cl. ..... 415/53.1; 415/203; 415/214.1; 416/170 R; 416/244 R

(58) Field of Search ..... 415/53.1, 203, 415/214.1, 124.1; 416/170 R, 244 R; 403/329, 326

(56) References Cited

U.S. PATENT DOCUMENTS 3,260,442 * 7/1966 Laing ..... 415/53.1
3,905,379 * 9/1975 Churas et al. ..... 132/9
4,859,888 * 8/1989 Ohbayashi et al. ..... 310/68 R
5,083,052 * 1/1992 Ochi ..... 310/64
5,547,018 * 8/1996 Takahashi et al. ..... 165/267

FOREIGN PATENT DOCUMENTS

55104597 * 11/1980 (JP) .

* cited by examiner

*Primary Examiner*—F. Daniel Lopez
*Assistant Examiner*—Ninh Nguyen
(74) *Attorney, Agent, or Firm*—Chan Law Group; Marcia Devon

(57) ABSTRACT

The present invention relates to a combined structure for a cross-flow fan comprising a rotor mounting having a magnet ring and a coil enclosed therein, a fan mounted under the rotor mounting, protrusions for attaching the fan to the rotor mounting so as to easily assemble the rotor mounting and the fan together, a stator mounting mounted above the rotor mounting, a housing, and a hook for attaching the stator mounting to the housing. The housing comprises an entry and an exit and contains the rotor mounting, the fan and the stator mounting.

5 Claims, 4 Drawing Sheets

COMBINED STRUCTURE OF CROSS-FLOW FAN

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The invention pertains generally to a cross-flow fan, and more particularly to a combined structure of cross-flow fan which is easily manufactured and assembled.

2. Description of the Background Art

A conventional cross-flow fan mainly comprises a stator mounting, a rotor mounting, a fan and a housing. The conventional rotor mounting comprises a magnet ring, wherein the magnet ring cannot be manufactured together with the fan, which is typically made of plastic, because of the differences in materials. Alternatively, after the fan is manufactured, the magnet ring is installed in the fan for engagment with the fan. The conventional way to combine them is to adhere the magnet ring and fan together. However, such an installation process easily results in the ruin of fan blades so that it is difficult to manufacture the fan, and the quality is difficult to control. Additionally, the conventional housing of the cross-flow fan comprises an upper housing and a lower housing which are difficult to be combined.

Accordingly, there exists a need for a cross-flow fan having components that are easily and readily assembled together, thereby maximizing the quality of the fan. The present invention satisfies these needs, as well as others, and generally overcomes the deficiencies found in the background art.

BRIEF SUMMARY OF THE INVENTION

The present invention is a combined structure for a cross-flow fan which generally comprises a rotor mounting having a magnet ring and a coil enclosed therein, a fan mounted beneath the rotor mounting, means for attaching the fan to the rotor mounting that provides for easy assembly of the rotor mounting and the fan together, a stator mounting mounted above the rotor mounting, a housing, and a means for attaching the stator mounting to the housing. The housing includes an entry and an exit and contains the rotor mounting, the fan and the stator mounting.

An object of the invention is to provide a combined structure of a cross-flow fan such that the rotor mounting is easily engaged with the fan, and the outer housing is easily assembled together.

Another object of the invention is to provide a combined structure of a cross-flow fan wherein the elements can be respectively manufactured and assembled such that the cross-flow fan can be easily assembled and the quality of the cross-flow fan can be controlled.

Another object of the invention is to provide a means for easily attaching the fan to the rotor mounting such that rotation of the rotor mounting causes a corresponding rotation of the fan.

Still another object of the invention is to provide a means for easily attaching the stator mounting onto the housing so that the stator mounting and the housing can be easily assembled together.

Further objects and advantages of the invention will be brought out in the following portions of the specification, wherein the detailed description is for the purpose of fully disclosing preferred embodiments of the invention without placing limitations thereon.

BRIEF DESCRIPTON OF THE DRAWINGS

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 4. It will be appreciated that the apparatus may vary as to configuration and as to details of the parts without departing from the basic concepts as disclosed herein.

Figure 1:
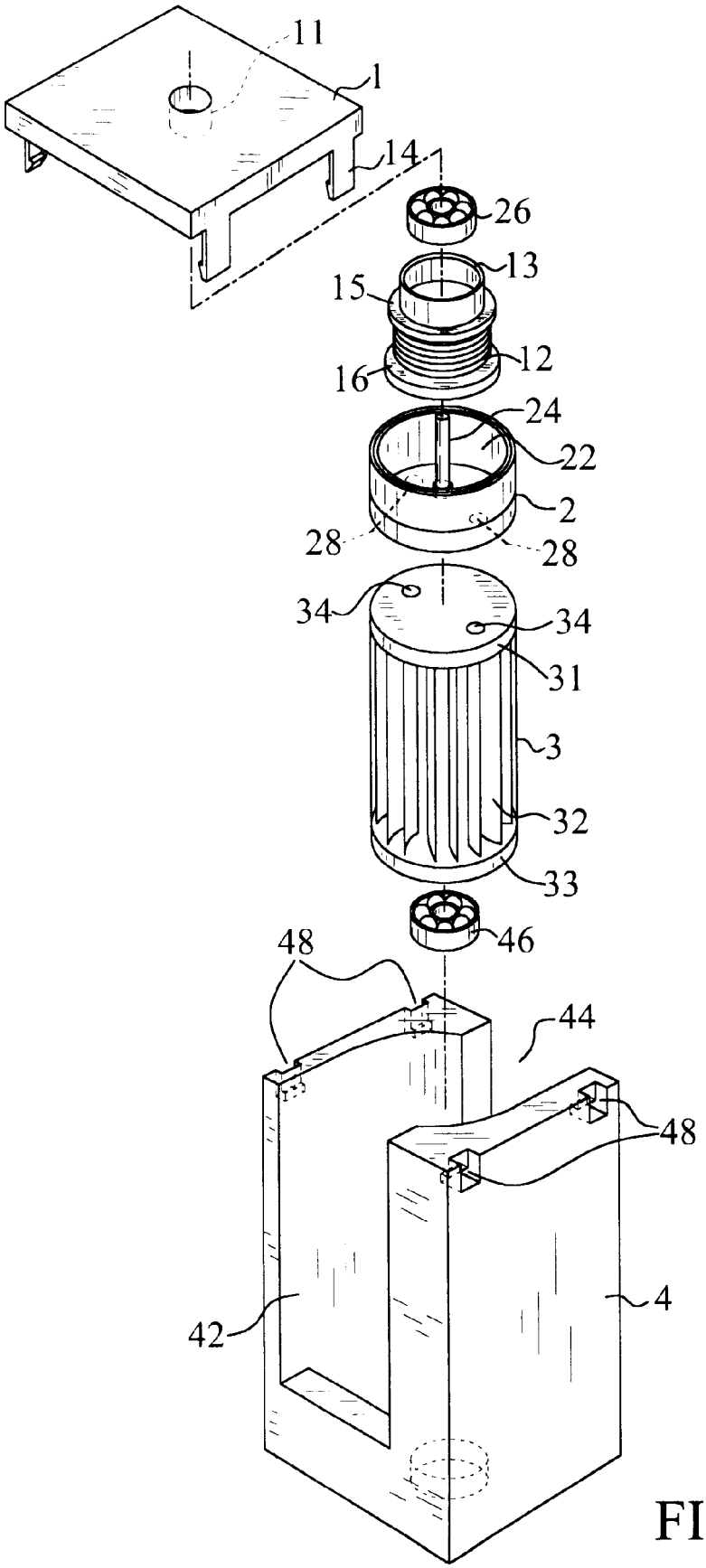
FIG. 1 is an exploded view of a cross-flow fan assembly in accordance with the invention.

Referring first to FIG. 1, a cross-flow fan assembly, in accordance with the present invention, is generally shown. The cross-flow fan assembly comprises a stator mounting 1, a rotor mounting 2, a fan 3 and a housing 4.

Rotor mounting 2 comprises a magnet ring 22 disposed therein, a rotor shaft 24, a bearing 26 and two protrusions 28, which are circular, extending below rotor mounting 2. Fan 3 comprises an upper cover 31, a lower cover 33. a plurality of fan blades disposed longitudinally therebetween. Fan 3 and is mounted beneath rotor mounting 2.

Upper cover 31 of fan 3 includes two recesses 34, which are circular, for receiving two circular protrusions 28 of rotor mounting. Fan 3 can be manufactured together with upper cover 31 and then engaged with lower cover 33. Alternatively, fan blades 32 can also be manufactured together with lower cover 33 and then engaged with upper cover 31. Moreover, fan blades 32 can also be first manufactured and then engaged with upper cover 31 and lower cover 33. Protrusions 28 and recesses 34 serve as a means for attaching or coupling fan 3 to rotor mounting 2, whereby rotation of rotor mounting 2 causes a like rotation of fan 3. Recesses 34 are adapted to easily receive protrusions 28 as thereby, allowing rotor mounting 2 and fan 3 to be easily assembled together.

Stator mounting 1 comprises a coil 12, a hub 11 extending downwardly and mounted on the center of stator mounting 1 and a plurality of hooks 14. Stator mounting 1 is mounted on rotor mounting 2.

Coil 12 is mounted within magnet ring 22 for induction with the magnet ring 22. A shaft tube 13 can be mounted in coil 12. An upper polar plate 15 and a lower polar plate 16 affixes coil 12 on shaft tube 13, which is then mounted on hub 11 of stator mounting 1.

Housing 4 contains stator mounting 1, rotor mounting 2 and fan 3. Housing 4 comprises an entry 42, an exit 44, a bearing 46 and a plurality of receptors 48. Entry 42 of housing 4 is larger than exit 44 of housing 4. When stator mounting 1 is positioned over housing 4, receptors 48 are in the corresponding position of hooks 14 to allow for engagement of hooks 14 with receptors 48 as means for attaching stator mounting 1 and housing 4 together.

Figure 2:
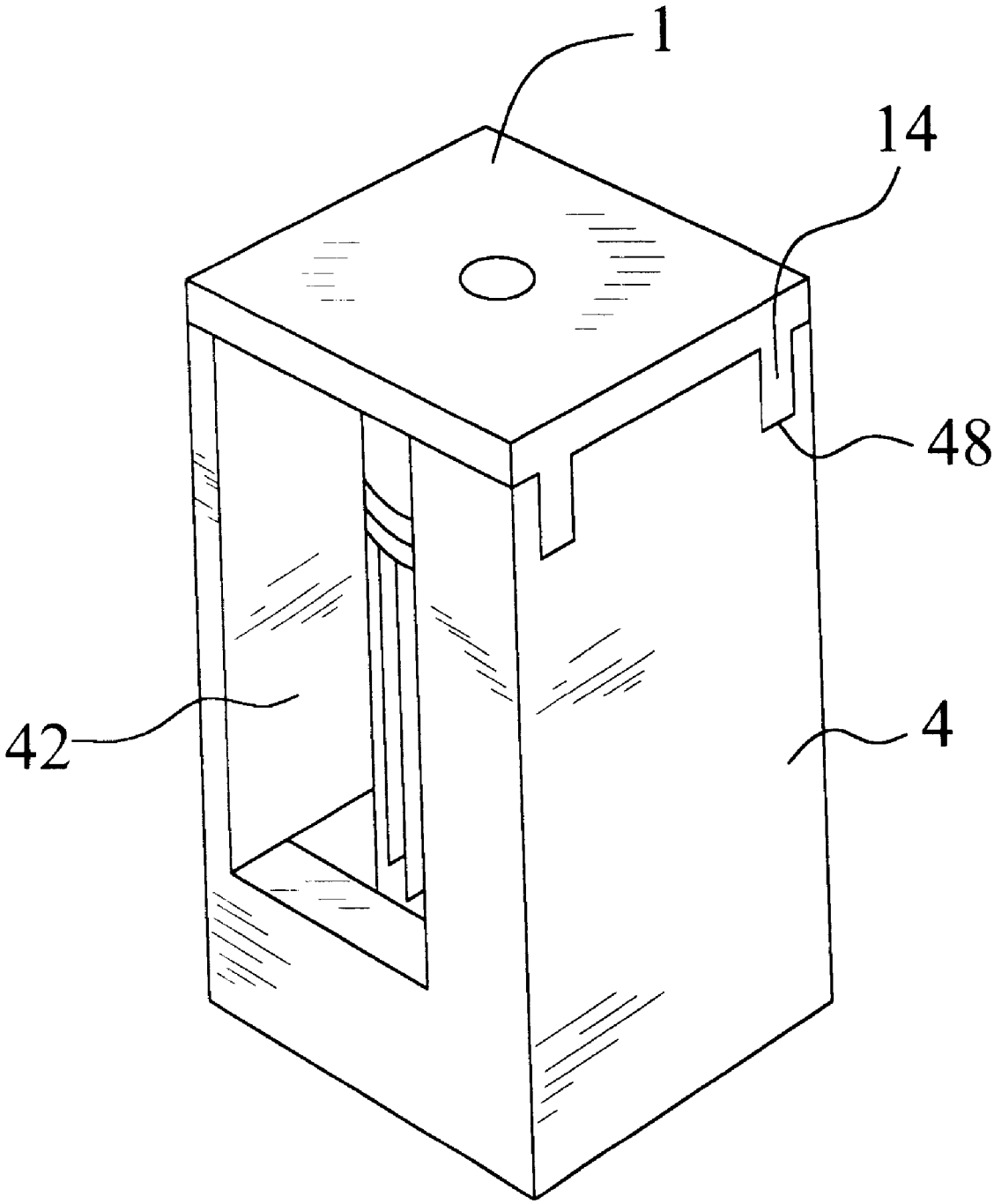
FIG. 2 is a perspective view of the cross-flow fan assembly shown in FIG. 1.

Referring also to FIG. 2, a perspective view of the cross-flow fan assembly is generally shown. Hooks 14 engage with recesses 48 for assembling stator mounting 1 and housing 4 as shown, thereby allowing housing 4 and stator mounting 1 to be easily assembled together.

Figure 3:
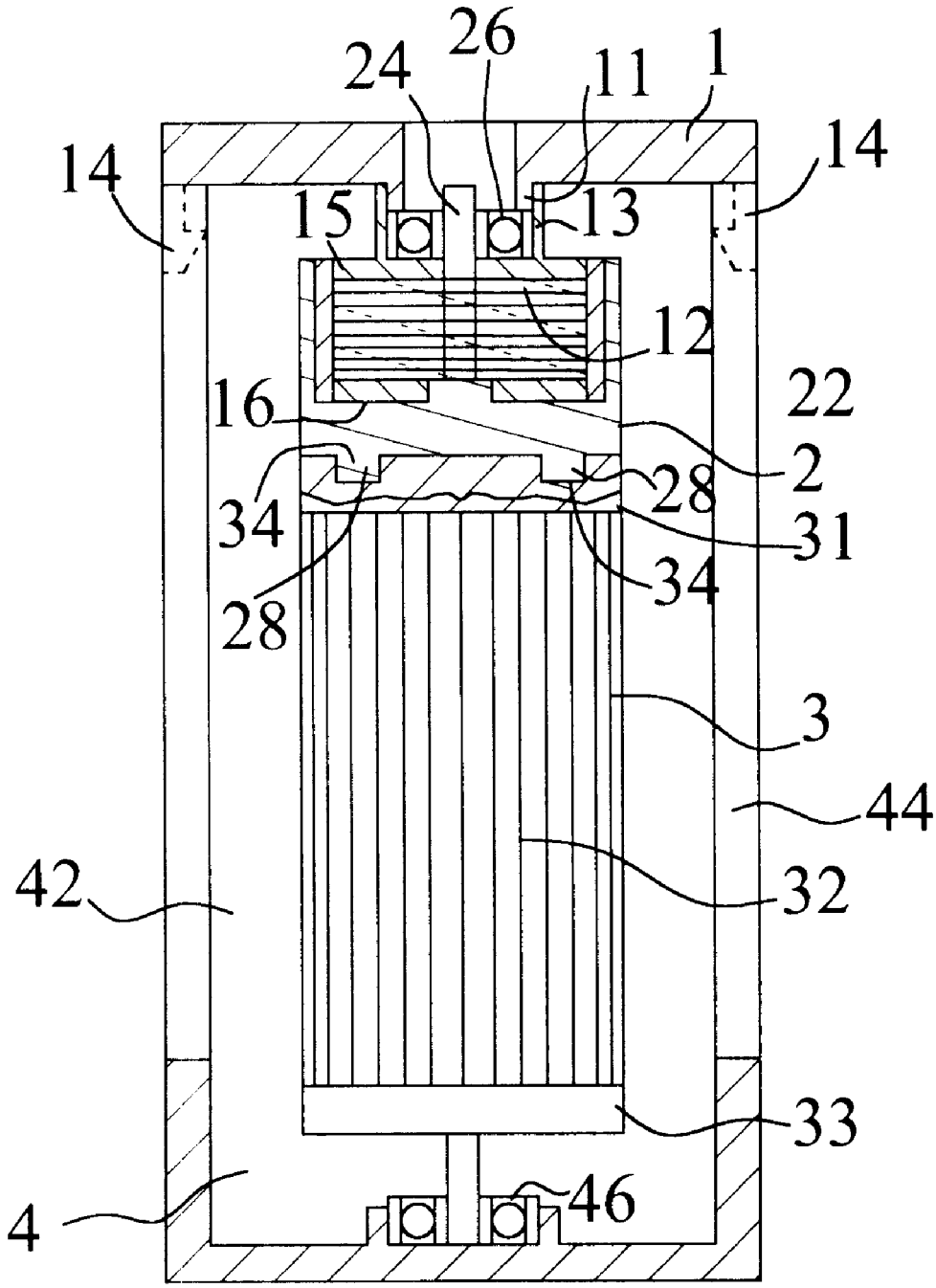
FIG. 3 is a cross-sectional view of the cross-flow fan assembly shown in FIG. 1.

Referring also to FIG. 3, it can be seen in the cross-sectional view of the cross-flow fan assembly that due to the design of the invention, the arrangement of the elements is relatively compact and efficient. The elements can be respectively manufactured and then assembled together. The stator structure can be mounted in magnet ring 22 for induction with magnet ring 22 and rotation of rotor mounting 2. Bearing 26 is mounted around rotor shaft 24. Bearing 46 is mounted below fan 3. Both bearing 46 and bearing 26 allow rotor mounting 2 and fan 3 to rotate about a fixed axis. It can be seen readily seen, therefore, that rotor mounting 2 and fan 3 can be easily assembled together.

Figure 4:
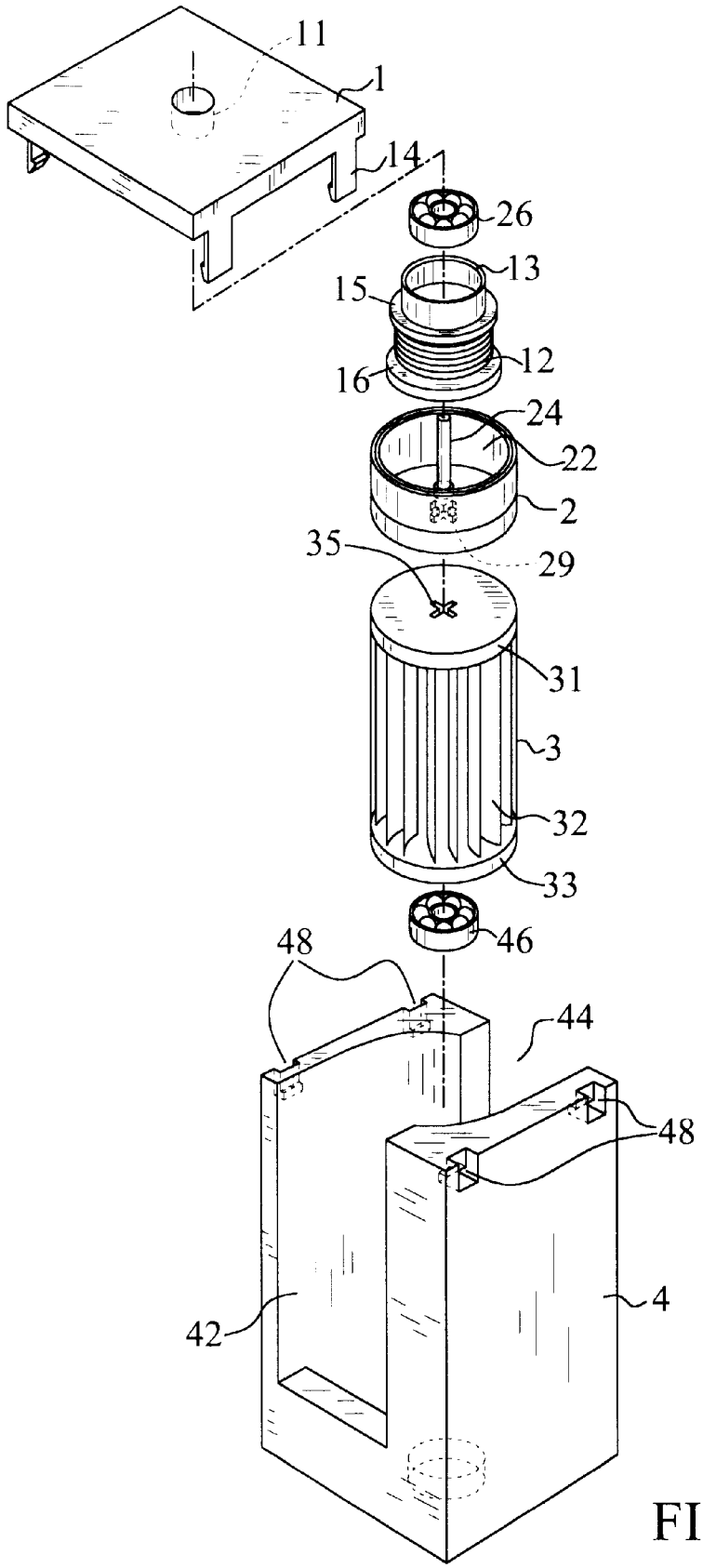
FIG. 4 is an exploded view of an alternative embodiment of a cross-flow fan assembly in accordance with the present invention.

Referring also to FIG. 4, an exploded view of an alternative embodiment of a cross-flow fan assembly is generally shown. In the alternative embodiment, a protrusion 29, having a cross shape, and a recess 35 adapted to receive cross-shaped protrusion 29 serves as a means for attaching or coupling rotor mounting 2 and fan 3 together. Since cross recess 35 is adapted to receive cross protrusion 29 therein, it can be readily seen that rotor mounting 2 and fan 3 to be easily assembled together.

Accordingly, it will be seen that this invention provides for a quick and reliable means for rotatably coupling the rotor mounting and the fan, along with the compact assembly of the cross-flow fan within a housing. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A cross-flow fan apparatus, comprising:

a housing, said housing including an entry and an exit and a plurality of recesses;

a rotor mounting rotatably disposed within said housing, said rotor mounting including a magnetic ring and a coil;

a fan mounted beneath said rotor mounting, said fan including a plurality of fan blades;

means for rotatably coupling said fan to said rotor mounting;

a stator mounting disposed above said rotor mounting; and a plurality of hooks, each hook engaging one of said plurality of recesses in said housing thereby attaching said stator mounting to said housing.

2. The cross-flow fan apparatus recited in claim 1, wherein said means for rotatably coupling said fan to said rotor comprises a protrusion in said rotor mounting and a recess in said fan for receiving said protrusion.

3. The apparatus recited in claim 1, wherein said entry of said housing is bigger that said exit of said housing.

4. The apparatus recited in claim 1, wherein said means for attaching said fan comprises at least one protrusion extending downwardly from said rotor mounting and at least one corresponding recess for receiving said protrusion.

5. A cross-flow fan apparatus, comprising:

a housing, said housing including an entry and an exit;

a stator mounting, said stator including a coil disposed thereon;

a plurality of hooks formed on said stator mounting; and a plurality of receptors for receiving said hooks.

* * * * *

UNITED STATES PATENT AND TRADEMARK OFFICE

CERTIFICATE OF CORRECTION

PATENT NO. : 6,210,101 B1
DATED : April 3, 2001
INVENTOR(S) : Alex Horng

It is certified that error appears in the above-identified patent and that said Letters Patent is hereby corrected as shown below:

Column 1,
Line 30 currently reads "engagment" should read -- engagement --

Column 2,
Line 44 currently reads "cover 33. a plurality" should read -- cover 33, and a plurality --

Column 4,
Line 1 currently reads "many specificities" should read -- much specificity --

Signed and Sealed this

Twenty-eighth Day of May, 2002

*Attest:*

*Attesting Officer*

JAMES E. ROGAN
*Director of the United States Patent and Trademark Office*